US008728619B2

(12) United States Patent
Fukushima et al.

(10) Patent No.: US 8,728,619 B2
(45) Date of Patent: May 20, 2014

(54) HIGHLY FUNCTIONAL POLYETHYLENE FIBER EXCELLENT IN FORMING PROCESSABILITY

(75) Inventors: Yasunori Fukushima, Shiga (JP); Shoji Oda, Shiga (JP); Akira Hamano, Shiga (JP); Minoru Masuda, Fukui (JP)

(73) Assignee: Toyo Boseki Kabushiki Kaisha, Osaka (JP)

( * ) Notice: Subject to any disclaimer, the term of this patent is extended or adjusted under 35 U.S.C. 154(b) by 0 days.

(21) Appl. No.: 13/579,753

(22) PCT Filed: Jan. 24, 2011

(86) PCT No.: PCT/JP2011/051185
§ 371 (c)(1),
(2), (4) Date: Aug. 17, 2012

(87) PCT Pub. No.: WO2011/102186
PCT Pub. Date: Aug. 25, 2011

(65) Prior Publication Data

US 2013/0029552 A1 Jan. 31, 2013

(30) Foreign Application Priority Data

Feb. 19, 2010 (JP) ..... 2010-035195

(51) Int. Cl.
*D02G 3/00* (2006.01)

(52) U.S. Cl.
USPC ..... 428/365; 428/364; 442/181; 442/301; 442/304

(58) Field of Classification Search
USPC ..... 428/364, 365; 442/181, 301, 304
See application file for complete search history.

(56) References Cited

U.S. PATENT DOCUMENTS

| | | | |
|---|---|---|---|
| 6,969,553 | B1 | 11/2005 | Tam et al. |
| 7,056,579 | B2 | 6/2006 | Sakamoto et al. |
| 7,247,372 | B2 | 7/2007 | Sakamoto et al. |
| 7,736,564 | B2 | 6/2010 | Sakamoto et al. |
| 2005/0003182 | A1 | 1/2005 | Sakamoto et al. |
| 2005/0118418 | A1 | 6/2005 | Sakamoto et al. |
| 2007/0190321 | A1 | 8/2007 | Sakamoto et al. |

FOREIGN PATENT DOCUMENTS

| | | |
|---|---|---|
| JP | 2003055833 | 2/2003 |
| JP | 3666635 | 4/2005 |
| JP | 3832631 | 7/2006 |
| JP | 4042039 | 11/2007 |
| JP | 4042040 | 11/2007 |
| JP | 4337040 | 7/2009 |
| JP | 4337233 | 7/2009 |
| JP | 4389142 | 10/2009 |

OTHER PUBLICATIONS

International Search Report for PCT/JP2011/051185 (Apr. 19, 2011).
European Patent Office, Extended Search Report in EP Application No. 11744475.2-1304/2537965 (dated Oct. 23, 2013).

*Primary Examiner* — Andrew Piziali
(74) *Attorney, Agent, or Firm* — Fish & Richardson P.C.

(57) ABSTRACT

The present invention provides a highly functional polyethylene fiber excellent in the cut resistance, has a high dimensional stability at about room temperature at which products are used, has a high shrinkage rate and stress, and excellent in forming processability when processed at a low temperature much less than a melting point of a polyethylene. And the present invention provides a highly functional polyethylene fiber excellent in processability at a low temperature, wherein an intrinsic viscosity [η] is higher than or equal to 0.8 dL/g, and is not higher than 4.9 dL/g, ethylene is substantially contained as a repeating unit, and a thermal stress at 40° C. is lower than or equal to 0.05 cN/dtex, and a thermal stress at 70° C. is higher than or equal to 0.05 cN/dtex, and is not higher than 0.25 cN/dtex. Further the present invention provides strings, ropes, woven/knitted textiles, and gloves thereof.

4 Claims, No Drawings

HIGHLY FUNCTIONAL POLYETHYLENE FIBER EXCELLENT IN FORMING PROCESSABILITY

TECHNICAL FIELD

The present invention relates to a polyethylene fiber having a high dimensional stability at about room temperature, and offering a high shrinkage and high stress performance when formed and processed at a low temperature less than a melting point of a polyethylene. More specifically, the present invention relates to a polyethylene fiber that offers an excellent cut-resistance when used for meat tying strings, safety ropes, finishing ropes, fabrics and tapes offering high shrinkage, and protective covers for various industrial materials.

BACKGROUND ART

Conventionally, cotton which is a natural fiber, and an organic fiber are used as a cut-resistant raw material, and woven/knitted textiles into which such a fiber and the like are knitted are widespread in fields in which cut resistance is required.

Knitted products and woven products have been suggested which are produced by using spun yarns of a high strength fiber such as an aramid fiber so as to provide cut resistance. However, the knitted products and woven products have been unsatisfactory from the standpoint of fiber detachment and durability. On the other hand, another method in which cut resistance is enhanced by using a metal fiber together with an organic fiber or a natural fiber is attempted. However, the use of a metal fiber not only causes texture to become hard, thereby deteriorating flexibility, but also causes product weight to become heavy, thereby become difficult to handle.

As an invention for solving the aforementioned problems, a polyethylene fiber having a high elastic modulus has been suggested which is produced by a so-called gel spinning method using a solution in which a polyethylene is dissolved in a solvent (for example, see Patent Literature 1). However, the elastic modulus of the polyethylene fiber is excessively high, so that a problem arises that the fiber has a texture representing an increased hardness. Further, a problem arises that the use of the solvent causes deterioration of a working environment for producing the polyethylene fiber. Further, a problem arises that the solvent which remains contained in the polyethylene fiber obtained as products causes an environmental load in indoor and outdoor applications even in a case where the solvent which remains contained therein is slight.

Further, the specifications are diversified in fields in which the cut-resistance is required, and various applications are considered. For example, some of cut-resistant gloves may be produced by a heat treatment process being performed during a resin treatment for prevention of slipping, whereas knitted fabrics which are not subjected to the resin treatment may be used as they are. In this case, in a temperature range (about 20° C. to 40° C.) in actual use, a dimensional stability is required, and a shrinkage stress and a shrinkage rate are preferably low. Furthermore, as another application, an application as protective covers for various industrial materials is considered. The protective cover is highly required to have, in addition to the cut resistance, a function of matching the shape of the cover with a shape of the material as accurately as possible. In order to produce a protective cover which meets such needs, the protective cover may be produced as a woven/knitted textile formed in a shape corresponding to the shape of the material. However, in this case, a problem arises that, when the shape of the material is complicated, the shapes cannot be completely matched with each other, and the woven/knitted textile for covering may be partially loosened. In order to solve the problem, a manner may be considered in which a woven/knitted textile is produced by using yarns having a high thermal shrinkage rate, and a heat treatment is then performed to develop the high shrinkage, thereby obtaining a protective cover that has a corresponding shape. However, a melting point for a polyethylene fiber is lower than that for another resin, and a temperature at which the thermal shrinkage is caused to occur needs to be as low (70° C. to 100° C.) as possible. Therefore, it is preferable that a shrinkage stress and a shrinkage rate at 70° C. to 100° C. are relatively high. However, a polyethylene fiber that has a low shrinkage stress and a low shrinkage rate at about 20° C. to 40° C., and simultaneously has a high shrinkage stress and a high shrinkage rate at 70° C. to 100° C., cannot be obtained in a conventional manner, and selection needs to be made depending on applications (see Patent Literature 1, 2, 3, and 4).

Thus, a highly functional fiber that satisfies a required shrinkage rate in a predetermined temperature range, and has an excellent cut-resistance, and a protective woven/knitted textile formed thereof have yet to be completed.

CITATION LIST

Patent Literature

PTL 1: Japanese patent No. 3666635
PTL 2: Japanese published unexamined application No. 2003-55833
PTL 3: Japanese patent No. 4042039
PTL 4: Japanese patent No. 4042040

SUMMARY OF INVENTION

Problems to be Solved by the Invention

An object of the present invention is to make available a polyethylene fiber that has a low shrinkage stress and a low shrinkage rate at 20° C. to 40° C., and has a high shrinkage stress and a high shrinkage rate at 70° C. to 100° C., in order to solve the aforementioned problems of the conventional art. When these physical properties are simultaneously satisfied, for example, applications, as meat tying strings, safety gloves, safety ropes, finishing ropes, covers for protecting industrial products, and the like, which require various cut-resistance performances, are realized without making selection.

Solution to the Problems

The inventors of the present invention have focused on and thoroughly studied values of a shrinkage rate and a thermal stress at various temperatures of a polyethylene fiber, to achieve the present invention.

Specifically, The first invention of the present invention is a highly functional polyethylene fiber, wherein an intrinsic viscosity [η] is higher than or equal to 0.8 dL/g, and is not higher than 4.9 dL/g, ethylene is substantially contained as a repeating unit, and a thermal stress at 40° C. is lower than or equal to 0.10 cN/dtex, and a thermal stress at 70° C. is higher than or equal to 0.05 cN/dtex, and is not higher than 0.30 cN/dtex.

The second invention of the present invention is a highly functional polyethylene fiber, wherein an intrinsic viscosity [η] is higher than or equal to 0.8 dL/g, and is not higher than 4.9 dL/g, ethylene is substantially contained as a repeating unit, and a thermal shrinkage rate at 40° C. is lower than or equal to 0.6%, and a thermal shrinkage rate at 70° C. is higher than or equal to 0.8%.

The third invention of the present invention is the highly functional polyethylene fiber according to claim 1 or claim 2, wherein a weight average molecular weight (Mw) of a polyethylene ranges from 50,000 to 600,000, and a ratio (Mw/Mn) of the weight average molecular weight to a number average molecular weight (Mn) is less than or equal to 5.0.

The forth invention of the present invention is the highly functional polyethylene fiber according to any one of claims 1 to 3, wherein a specific gravity is higher than or equal to 0.90, an average tensile strength is higher than or equal to 8 cN/dtex, and a modulus ranges from 200 cN/dtex to 750 cN/dtex.

The fifth invention of the present invention is the woven/knitted textile formed of the highly functional polyethylene fiber according to any one of claims 1 to 4.

The sixth invention of the present invention is a production method for producing a highly functional polyethylene fiber excellent in processability at a low temperature, the production method comprising melting and spinning a polyethylene in which an intrinsic viscosity [η] is higher than or equal to 0.8 dL/g, and is not higher than 4.9 dL/g, and ethylene is substantially contained as a repeating unit, drawing the polyethylene at a temperature higher than or equal to 80° C., rapidly cooling, after the drawing, drawn filaments at a cooling rate higher than or equal to 7° C./sec., and winding the drawn filaments having been thus obtained with a tensile tension ranging from 0.005 cN/dtex to 3 cN/dtex.

Advantageous Effects of the Invention

The highly functional polyethylene fiber of the present invention has a low shrinkage rate at temperatures approximate to actual use, and has a high shrinkage rate and stress at 70° C. to 100° C. Therefore, the highly functional polyethylene fiber has a high dimensional stability at temperatures in actual use, and can offer an excellently high shrinkage and an excellently high shrinkage stress at temperatures at which a mechanical property of a polyethylene is not deteriorated. Furthermore, strings, woven/knitted textiles, gloves, and ropes formed of the fiber of the present invention are excellent in cut-resistance, and offer excellent performance as, for example, meat tying strings, safety gloves, safety ropes, finishing ropes, and covers for protecting industrial products. Moreover, the polyethylene fiber of the present invention is widely applicable as not only formed products described above, but also highly shrinkable fabrics and tapes.

MODE FOR CARRYING OUT THE INVENTION

Hereinafter, the present invention will be described in detail.

An intrinsic viscosity of a highly functional polyethylene fiber excellent in dyeability according to the present invention is higher than or equal to 0.8 dL/g, and is not higher than 4.9 dL/g, is preferably higher than or equal to 1.0 dL/g, and is preferably not higher than 4.0 dL/g, and is more preferably higher than or equal to 1.2 dL/g, and is more preferably not higher than 2.5 dL/g. When the intrinsic viscosity of a highly functional polyethylene fiber is not higher than 4.9 dL/g, production of filaments by a melt spinning method is facilitated, and it is unnecessary to produce the filaments by using a so-called gel spinning, or the like. Therefore, the polyethylene fiber is superior in reduction of production cost, and simplification of working process steps. Further, in the melt spinning method, since no solvent is used for producing the fiber, influence on the working staff and the environments is small. As there is no solvent to be present in the fiber after manufacture, the product has no bad effect on the product user. On the other hand, when the intrinsic viscosity is higher than or equal to 0.8 dL/g, reduction of terminal groups of a molecule of a polyethylene leads to reduction of the defects of structure in the fiber. Therefore, cut resistance and dynamic physical properties of the fiber, such as a strength and a modulus, can be improved.

Preferably, the polyethylene used in the present invention substantially contains ethylene as a repeating unit. Further, in a range in which effects of the present invention can be obtained, not only an ethylene homopolymer but also a copolymer of ethylene and a small amount of another monomer can be used. Examples of the other monomer include α-olefins, acrylic acid and derivatives thereof, methacrylic acid and derivatives thereof, and vinyl silane and derivatives thereof. A copolymer of an ethylene homopolymer and the other monomer that is different from ethylene, may be used. Further, a blended component of two or more kinds of copolymers, or a blended component of an ethylene homopolymer and a homopolymer of the other monomer such as an α-olefin, may be used. Furthermore, a copolymer of these copolymers, or a copolymer with an ethylene homopolymer, or further, a blend with other homopolymer such as α-olefin and the like, may be contained. Furthermore, a partial crosslinked structure between an ethylene homopolymer and another (co)polymer, or between each (co)polymer, may be contained.

However, when the content of components other than ethylene increases too much, it prevents stretching. Thus, from the aspects of production of a high strength fiber having a great cut resistance, the other monomers such as an α-olefin is desirably not more than 5.0 mol % per monomer, preferably not more than 1.0 mol % per monomer, more preferably not more than 0.2 mol % per monomer. Needless to say, it may be a homopolymer of ethylene alone.

In the highly functional polyethylene fiber of the present invention, a molecular characteristic of the polyethylene as a raw material is such that the intrinsic viscosity is as described above, and a weight average molecular weight in the fibrous state ranges from 50,000 to 600,000, preferably ranges from 70,000 to 300,000, and more preferably ranges from 90,000 to 200,000. When the weight average molecular weight is less than 50,000, the number of molecular ends per cross-section area is increased due to the low molecular weight, which is assumed as becoming a structural defect, so that not only a high draw ratio cannot be obtained in a drawing process described below, but also a tensile strength of a fiber obtained by rapid cooling after the drawing process as described below is less than 8 cN/dtex. On the other hand, when the weight average molecular weight is higher than 600,000, a melt viscosity becomes very high in a melt spinning, and discharging from a nozzle becomes very difficult, which is unfavorable. A ratio (Mw/Mn) of the weight average molecular weight to a number average molecular weight is preferably less than or equal to 5.0. When the Mw/Mn is higher than 5.0, a tensile tension in the drawing process described below is increased due to a high molecular weight component being contained, which unfavourably causes breakage of filaments frequently in the drawing process.

In the highly functional polyethylene fiber of the present invention, a tensile strength is preferably higher than or equal to 8 cN/dtex. This is because the usage of the polyethylene fiber having such a strength can be expanded so as to cover a usage which cannot be realized by general-purpose fibers obtained by a melt spinning method.

The tensile strength is more preferably higher than or equal to 10 cN/dtex, and is even more preferably higher than or equal to 11 cN/dtex. Although the upper limit of the tensile strength need not be specified, it is difficult to obtain, by using a melt spinning method, a fiber having a tensile strength which is higher than or equal to 55 cN/dtex, in terms of a technique and industrial manufacturing.

In the highly functional polyethylene fiber of the present invention, a tensile modulus preferably ranges from 200 cN/dtex to 750 cN/dtex. This is because the usage of the polyethylene fiber having such an elastic modulus can be expanded so as to cover a usage which cannot be realized by general-purpose fibers obtained by a melt spinning method. The tensile modulus is preferably higher than or equal to 300 cN/dtex, and is preferably not higher than 700 cN/dtex, and is more preferably higher than or equal to 350 cN/dtex, and is more preferably not higher than 680 cN/dtex.

A method for producing the highly functional polyethylene fiber of the present invention is preferably a melt spinning method as described below. For example, in the gel spinning method which is one of methods for producing an ultrahigh molecular weight polyethylene fiber by using a solvent, although a high strength polyethylene fiber can be obtained, not only productivity is low, but also use of the solvent exerts a great influence on health of manufacturing staff and environments and on health of product user given a solvent to be present in the fiber.

For the highly functional polyethylene fiber of the present invention, the polyethylene described above is melt-extruded by using an extruder or the like, at a temperature which is higher than the melting point by 10° C. or more, preferably by 50° C. or more, and more preferably by 80° C. or more, and is supplied to a nozzle by using a metering device at a temperature which is higher than the melting point of the polyethylene by 80° C. or more, and preferably by 100° C. or more. Thereafter, the polyethylene is discharged at a throughput of 0.1 g/min. or more from a nozzle having a diameter which ranges from 0.3 mm to 2.5 mm, and preferably ranges from 0.5 mm to 1.5 mm. Subsequently, the discharged filaments are cooled to 5° C. to 40° C., and are thereafter wound at 100 m/min. or more. Furthermore, the wound filaments having been obtained are drawn, at least once, at a temperature lower than the melting point for the fiber. At this time, when the drawing is performed multiple times, it is preferable that a temperature for the drawing is increased toward a lattermost drawing. Furthermore, a temperature for the lattermost drawing is higher than or equal to 80° C., and is less than the melting point, and is preferably higher than or equal to 90° C., and is preferably less than the melting point. This temperature is a temperature to be satisfied at the drawing when the drawing is performed only once.

Furthermore, one of the significant features of the present invention is a method for processing the fiber having been drawn as described above. Specifically, one of the significant features is an introduction of and a condition for a process of rapidly cooling the fiber having been heated in the drawing process described above. It is favorable that the fiber having been heated and drawn is rapidly cooled at a cooling rate higher than or equal to 7° C./sec. The cooling rate is preferably 10° C./sec., and is more preferably 20° C./sec. In a case where the cooling rate is lower than 7° C./sec., due to molecular chains in the fiber becoming loosened immediately after the drawing process, a residual stress at a high temperature (70° C. to 100° C.) is reduced. A thermal stress of the highly functional polyethylene fiber of the present invention at 70° C. is higher than or equal to 0.05 cN/dtex, and is not higher than 0.30 cN/dtex, is preferably higher than or equal to 0.08 cN/dtex, and is preferably not higher than 0.25 cN/dtex, and is more preferably higher than or equal to 0.10 cN/dtex, and is more preferably not higher than 0.22 cN/dtex. Furthermore, a thermal shrinkage rate at 70° C. is higher than or equal to 0.8%, and is not higher than 5.0%, and is preferably higher than or equal to 1.2%, and is not higher than 4.8%.

Furthermore, another one of the significant features of the present invention is that a tensile tension for the fiber is controlled after the cooling process has been further performed following the drawing process described above. Specifically, it is a tensile tension for winding performed after the cooling process. When a tensile tension for winding is appropriate in a state where the fiber has been cooled, a shrinkage stress and a shrinkage rate of the fiber at a temperature which is higher than or equal to 20° C., and is not higher than 40° C., can be controlled. The tensile tension preferably ranges from 0.005 cN/dtex to 3 cN/dtex. The tensile tension more preferably ranges from 0.01 cN/dtex to 1 cN/dtex, and even more preferably ranges from 0.05 cN/dtex to 0.5 cN/dtex. When the tensile tension after the cooling process is lower than 0.005 cN/dtex, the loosening of the fiber is increased in the process, and an operation cannot be performed. On the other hand, when the tensile tension is higher than 3 cN/dtex, breakage of fiber filaments or napping caused by breakage of a single filament unfavorably occurs in the process. The shrinkage stress, at 40° C., of the highly functional polyethylene fiber of the present invention having been thus obtained is less than or equal to 0.10 cN/dtex, is preferably less than or equal to 0.8 cN/dtex, and is more preferably less than or equal to 0.6 cN/dtex. Further, the shrinkage rate, at 40° C., of the highly functional polyethylene fiber of the present invention is less than or equal to 0.6%, is preferably less than or equal to 0.5%, and is more preferably less than or equal to 0.4%.

Preferably, the highly functional polyethylene fiber of the present invention is used to produce a covered elastic yarn having an elastic fiber as a core yarn, and is produced into a woven/knitted textile using the covered elastic yarn. A wearing feeling is enhanced, and putting-on and taking-off is facilitated. Further, a cut-resistance tends to be somewhat improved. The elastic fiber may be, but is not limited to, a polyurethane fiber, a polyolefin fiber, or a polyester fiber. The elastic fiber described herein refers to a fiber representing a recovery property which is higher than or equal to 50% when elongated by 50%.

For a method for producing the covered elastic yarn, a covering machine may be used, or an elastic yarn and a non-elastic fiber may be assembled and twisted while the elastic yarn is being drafted. A rate at which the elastic fiber is mixed is higher than or equal to 1 mass %, is preferably higher than or equal to 5 mass %, and is more preferably higher than or equal to 10 mass %. When the rate at which the elastic fiber is mixed is low, a sufficient recovery from elongation and contraction cannot be obtained. However, when the rate is excessively high, a strength is reduced. Therefore, the rate is preferably not higher than 50 mass %, and is more preferably not higher than 30 mass %.

The protective woven/knitted textile of the present invention preferably indicates an index value of a coup tester which is higher than or equal to 3.9 in light of cut-resistance and durability. Further, although an upper limit of the index value of the coup tester is not defined, the fiber may be thickened in order to increase the index value of the coup tester. However, in this case, texture characteristics tend to be deteriorated. Therefore, in light thereof, the upper limit of the index value of the coup tester is preferably 14. Further, the range of the index values of the coup tester is set such that the index value of the coup tester is more preferably higher than or equal to 4.5, and is more preferably not higher than 12, and the index value of the coup tester is even more preferably higher than or equal to 5, and is even more preferably not higher than 10.

The fibers and/or the covered elastic yarns of the present invention are knitted by a knitting machine to obtain a knitted textile. Alternatively, the fibers and/or the covered elastic yarns of the present invention are woven by a weaving machine to obtain a fabric.

A base cloth of the cut-resistant woven/knitted textile of the present invention contains the composite elastic yarns as a fiber component. In light of the cut-resistance, a proportion of the composite elastic yarns to the base cloth is preferably higher than or equal to 30% by mass, is more preferably higher than or equal to 50% by mass, and is even more preferably higher than or equal to 70% by mass.

Synthetic fibers such as polyester fibers, nylon fibers, and acrylic fibers, natural fibers such as cotton and wool, regenerated fibers such as rayon fibers, and/or the like may be contained such that a proportion of these other fibers except the composite elastic yarns is less than or equal to 70% by mass. In light of abrasion-durability, polyester multifilaments or nylon filaments in which one filament is a 1 to 4 dtex filament, are preferably used.

The measurement and evaluation of the characteristic of the polyethylene fiber obtained in the present invention were performed in the following manner.

(1) Intrinsic Viscosity

Using a capillary viscosity tube of the Ubbelohde type, different dilute solutions were measured for specific viscosity in decalin at 135° C., and intrinsic viscosity was determined by drawing a straight line on the plot of their viscosity against concentrations by the method of least squares and extrapolation of the straight line toward zero concentration. In the measurement of viscosity, a sample was divided or cut to about 5 mm in length, and an antioxidant (under the trade name "Yoshinox BHT" available from Yoshitomi Pharmaceutical Industries, Ltd.) was added in 1 wt % relative to the polymer, followed by stirring at 135° C. for 4 hours for dissolution to give a solution for measurement.

(2) Weight Average Molecular Weight Mw, Number Average Molecular Weight Mn, and Mw/Mn.

The weight average molecular weight Mw, the number average molecular weight Mn, and the Mw/Mn were measured by the gel permeation chromatography (GPC). As a GPC instrument, GPC, 150C ALC/GPC manufactured by Waters was used; as columns, one GPC UT802.5 GPC column and two GPC UT806M columns, both manufactured by SHODEX, were used; and a differential refractometer (RI detector) was used as a detector; to perform measurement. After a sample was divided or cut to about 5 mm in length, the sample was melted at 145° C. in a measurement solvent. As the measurement solvent, o-dichlorobenzene was used and a column temperature was set to 145° C. A concentration of a sample was adjusted to 1.0 mg/ml, and 200 microliter of the sample solution was injected, to perform measurement. A molecular weight calibration curve was obtained, by a universal calibration method, by using a sample of a polystyrene the molecular weight of which was known.

(3) Strength, Elongation, and Elastic Modulus

Measurement was made in compliance with JIS L1013 8.5.1. A strength and an elastic modulus were measured by using a "TENSILON universal material testing instrument" manufactured by ORIENTEC Co., Ltd. A strain-stress curve was obtained under the condition that a length (a length between chucks) of a sample was 200 mm, an elongation rate was 100%/min., an ambient temperature was 20° C., and a relative humidity was 65%. A strength (cN/dtex) and an elongation (%) were calculated based on a stress and an elongation at breaking point, and an elastic modulus (cN/dtex) was calculated from the tangent line providing a maximum gradient on the curve in the vicinity of the originating point. At this time, an initial load applied to the sample at the measurement was one tenth of a linear density. An average of values obtained in ten measurements was used for each case.

(4) Measurement of Thermal Stress

A thermal stress strain measurement apparatus (TMA/SS120C) manufactured by Seiko Instruments Inc. was used for the measurement. An initial load of 0.01764 cN/dtex was applied to the fiber having a length of 20 mm, and a temperature was increased at a temperature rising rate of 20° C./min., thereby obtaining measurement results for room temperature (20° C.) to the melting point. Based on the measurement results, a stress at 40° C. and a stress at 70° C. were obtained.

(5) Measurement of Shrinkage Rate

Measurement was made in compliance with a dry-heat shrinkage rate (b) method of JIS L1013 8.18.2. Fiber samples to be measured were each cut into a size of 70 cm, and positions distant from both ends, respectively, by 10 cm, were marked so as to show that a length of each sample was 50 cm. Next, the fiber samples were hung so as to prevent a superfluous load from being applied thereto, and the fiber samples in this hanging state were heated at a predetermined temperature in a hot air circulating type heating oven for 30 minutes. Thereafter, the fiber samples were taken out of the heating oven, and gradually cooled down sufficiently to room temperature. Thereafter, a length between the positions which had been marked on each fiber sample at the beginning, was measured. The predetermined temperature was 40° C. and 70° C. The shrinkage rate can be obtained by using the following equation.

$$\text{Shrinkage rate (\%)} = 100 \times (\text{length of unheated fiber sample} - \text{length of heated fiber sample}) / (\text{length of unheated fiber sample})$$

An average of values obtained by two measurements was used for each case.

(6) Cut Resistance

As an evaluation method, a method using a coup tester (cut tester manufactured by SODMAT) was used for this evaluation. An aluminum foil was provided on a sample stage of the tester, and a sample was put on the aluminum foil. Next, a circular blade provided on the tester was caused to travel on the sample while the circular blade was being simultaneously rotated in a direction opposite to the traveling direction. When the sample had been cut, the circular blade and the aluminum foil contacted each other, so that an electric current flows, and it was determined that the cut resistance test had been ended. While the circular blade was operating, a counter mounted to the tester counts numerical values, and the numerical values were recorded.

In the test, a plain-woven cotton fabric having a weight per unit area which was about 200 g/m$^2$ was used as a blank, and a cut level of the test sample (glove) was evaluated. For the test sample (glove), fibers obtained in examples and comparative examples were collectively aligned, or separated, to prepare filaments in a range of 440±10 dtex. The filaments were used as a sheath yarn, and a 155 dtex spandex ("Espa (registered trademark)" manufactured by TOYOBO CO., LTD.) was used as a core yarn, to obtain a single covering yarn. The obtained single covering yarns were used to knit a glove having a weight per unit area which was 500 g/m$^2$, by using a glove knitting machine manufactured by SHIMA SEIKI MFG, LTD. The test was started with the blank, and the test of the blank and the test of the test sample were alternately performed, and the test sample was tested five times, and the test was ended with the sixth test of the blank, thereby completing one set of tests. Five sets of the tests described above were performed, and an average Index value obtained from the five sets of the tests was calculated as a substitute evaluation value for the cut-resistance. It is considered that the higher the Index value is, the more excellent the cut-resistance is.

The evaluation value obtained as described above was referred to as an Index, and the Index was calculated by using the following equation.

A=(a counted value for the cotton fabric obtained before the sample test+a counted value for the cotton fabric obtained after the sample test)/2

Index=(a counted value for the sample+A)/A

A cutter used for this evaluation was an L-type rotary cutter, manufactured by OLFA CORPORATION, having ϕ45 mm. The material thereof was an SKS-7 tungsten steel, and a thickness of the blade was 0.3 mm. An applied load in the test was 3.14 N (320 gf). Thus, an evaluation was made.

EXAMPLES

Hereinafter, the present invention will be specifically described by means of examples. However, the present invention is not limited to examples described below.

Example 1

A high-density polyethylene in which an intrinsic viscosity was 1.9 dL/g, a weight average molecular weight was 120,000, and a ratio of the weight average molecular weight to a number average molecular weight was 2.7, was melted at 280° C., and discharged from a spinneret having an orifice diameter of ϕ0.8 mm, and 300H, at a nozzle surface temperature of 280° C., at a single hole throughput of 0.5 g/min. Discharged filaments were caused to pass through a heat-retaining section which was 10 cm long, were then cooled in a quencher at 40° C. and at 0.4 m/s, and were wound into a cheese at a spinning speed of 250 m/min., thereby obtaining non-drawn filaments. The non-drawn filaments having been obtained were heated by using hot air at 100° C., and drawn 10-fold, and, subsequent thereto, the drawn filaments were immediately cooled in a water bath in which the water temperature was 15° C., and wound. At this time, a cooling rate was 54° C./sec. Further, a tensile tension with which the drawn filaments were wound was 0.1 cN/dtex.

Example 2

A fiber was obtained in the same manner as for example 1 except that, in a drawing machine in which a roller temperature and an ambient temperate were each set to 65° C., 2.8-fold drawing was performed in one action between two driving rollers, heating by using hot air at 100° C. was further performed, and 5.0-fold drawing was performed. Physical properties of the obtained fiber, contents of organic substances, and an evaluation result are indicated in table 1.

Example 3

A fiber was obtained in the same manner as for example 1 except that, after the drawing, cooling was performed by using a cooling roller at a cooling rate of 10° C./sec. Physical properties of the obtained fiber, contents of organic substances, and an evaluation result are indicated in table 1.

Example 4

A fiber was obtained in the same manner as for example 1 except that tensile tension for winding of the drawn filaments after the drawing and cooling was 1 cN/dtex. Physical properties of the obtained fiber, contents of organic substances, and an evaluation result are indicated in table 1.

Comparative Example 1

A slurry mixture of 90% by mass of decahydronaphthalene, and 10% by mass of an ultrahigh molecular weight polyethylene in which an intrinsic viscosity was 20 dL/g, a weight average molecular weight was 3,300,000, and a ratio of the weight average molecular weight to a number average molecular weight was 6.3, was melted by a screw-type kneader which was set to a temperature of 230° C. while being dispersed, and the melted mixture was supplied to a spinneret which was set to 170° C., and had 30 holes each having a diameter of 0.8 mm, by using a metering pump, at a single hole throughput of 1.0 g/min.

Nitrogen gas that was adjusted to 100° C. was supplied at a speed of 1.2 m/min. by using a slit-shaped gas supply orifice mounted vertically below a nozzle, so as to apply the nitrogen gas to filaments as uniformly as possible, thereby actively evaporating the decalin on a surface of the fiber filaments. Thereafter, the filaments were substantially cooled by air flow set to 30° C., and wound at a speed of 50 m/min. by a Nelson roller provided downstream of the nozzle. At this time, a solvent contained in the filaments was reduced such that the mass of the solvent was about half of the mass of the originally contained solvent.

Subsequent thereto, the obtained fiber filaments were drawn 3-fold in an oven having been heated to 120° C. The fiber filaments having been thus obtained were drawn 4.0-fold in an oven having been heated to 149° C. The fiber filaments having been thus drawn were wound at 1 cN/dtex without cooling the fiber filaments. A cooling rate in the case of no cooling process having been performed after the drawing process was 1.0° C./sec. when estimated from a temperature of the wound filaments. Physical properties of the obtained fiber, and an evaluation result are indicated in table 1.

It was found that, while the obtained fiber had a favorable dimensional stability at 40° C., the obtained fiber had a low shrinkage rate and a low thermal stress value at 70° C., and the obtained fiber was not appropriate in applications in which the fiber was to be appropriately sized and formed into a desired shape by utilizing the thermal shrinkage.

Comparative Example 2

A high-density polyethylene in which an intrinsic viscosity was 1.6 dL/g, a weight average molecular weight was 96,000, a ratio of the weight average molecular weight to a number average molecular weight was 2.3, and the number of branched chains each having such a length as to contain at least five carbon atoms was 0.4 per 1000 carbon atoms, was extruded at 290° C. at a single hole throughput of 0.5 g/min. from a spinneret having 390H each having ϕ0.8 mm. The extruded fiber filaments were caused to pass through a heat-retaining section which was 15 cm long, were then cooled in a quencher at 20° C. and at 0.5 m/s, and were wound at a speed of 300 m/min., to obtain non-drawn filaments. A first step drawing was performed in which the non-drawn filaments were drawn 2.8-fold at 25° C. Further, heating to 105° C. and 5.0-fold drawing were performed. The filaments having been thus drawn were wound at 5 cN/dtex without cooling the filaments. Physical properties of the obtained fiber, and an evaluation result are indicated in table 1.

It was found that the obtained fiber had a high shrinkage rate and a high thermal stress, and thus had a poor dimensional stability, at 40° C.

Comparative Example 3

Drawn filaments were produced in the same condition as for comparative example 2 except that, in the second drawing, a temperature for the drawing was 90° C. and a draw ratio was 3.1.

Physical properties of the obtained fiber, and an evaluation result are indicated in table 1.

It was found that the obtained fiber had a high shrinkage rate and a high thermal stress, and thus had a poor dimensional stability, at 40° C.

Comparative example 4

Drawn filaments were produced in the same condition as for comparative example 3 except that a high-density polyethylene in which an intrinsic viscosity was 1.9 dL/g, a weight average molecular weight was 91,000, and a ratio of the weight average molecular weight to a number average molecular weight was 7.3, was used, and tensile tension for winding performed without conducting cooling process after the drawing was 0.005 cN/dtex. Physical properties of the obtained fiber, and an evaluation result are indicated in table 1.

It was found that while the obtained fiber had a favorable dimensional stability at 40° C., the obtained fiber had a low shrinkage rate and a low thermal stress value at 70° C., and forming processability at a low temperature was poor. Further, an excellent cut-resistance was not able to be obtained. Although the reason is unclear, it can be considered that molecular chains were loosened due to a low cooling rate and low tensile tension for winding.

Comparative Example 5

With the use of an ultrahigh molecular weight polyethylene in which an intrinsic viscosity was 8.2 dL/g, a weight average molecular weight was 1,020,000, and a ratio of the weight average molecular weight to a number average molecular weight was 5.2, heating at 300° C., and spinning were attempted. However, discharging from a nozzle was not able to be performed, and spinning was not able to be performed.

Comparative Example 6

A high-density polyethylene in which an intrinsic viscosity was 1.9 dL/g, a weight average molecular weight was 115,000, and a ratio of the weight average molecular weight to a number average molecular weight was 2.8, was extruded at 290° C., at a single hole throughput of 0.5 g/min., from a spinneret having 30H each having ϕ0.8 mm. The extruded fiber filaments were caused to pass through a heat-retaining section which was 10 cm long, then cooled in a quencher at 20° C. and at 0.5 m/s, and wound at a speed of 500 m/min, to obtain non-drawn filaments. The non-drawn filaments were drawn by using a plurality of Nelson rollers of which the temperatures were able to be controlled. A first step drawing was performed in which 2.0-fold drawing was performed at 25° C. Further, heating to 100° C. and 6.0-fold drawing were performed. After the drawing, winding at 5 cN/dtex was performed without conducting rapid cooling. Physical properties of the obtained fiber, and an evaluation result are indicated in table 1.

It was found that the obtained fiber had a poor dimensional stability at 40° C., the obtained fiber had a low shrinkage rate and a low thermal stress value at 70° C., and a forming processability at a low temperature was poor.

Comparative Example 7

Drawn filaments were produced in the same condition as for comparative example 3 except that, after the drawing process, a cooling rate in the case of cooling process was 10° C./sec. Physical properties of the obtained fiber, and an evaluation result are indicated in table 1.

It was found that the obtained fiber had a high shrinkage rate and a high thermal stress, and thus had a poor dimensional stability, at 40° C.

TABLE 1

| | | unit | Example 1 | Example 2 | Example 3 | Example 4 | Comparative Example 1 | Comparative Example 2 |
|---|---|---|---|---|---|---|---|---|
| Characteristic of a raw material | Intrinsic viscosity (raw polymer) | dL/g | 1.9 | 1.9 | 1.9 | 1.9 | 20 | 1.6 |
| | Mw (raw polymer) | — | 120,000 | 120,000 | 120,000 | 120,000 | 3,300,000 | 96,000 |
| | Mw/Mn (raw polymer) | — | 2.7 | 2.7 | 2.7 | 2.7 | 6.3 | 2.3 |
| | Spinning method | | melt spinning | melt spinning | melt spinning | melt spinning | solution spinning | melt spinning |
| Spinning condition | Nozzle temperature | ° C. | 280 | 280 | 280 | 280 | 170 | 290 |
| | Single hole throughput | g/min | 0.5 | 0.5 | 0.5 | 0.5 | 1 | 0.5 |
| | Spinning speed | m/min | 250 | 250 | 250 | 250 | 50 | 300 |
| 1st drawing step condition | Drawing temperature | ° C. | 100 | 65 | 100 | 100 | 120 | 25 |
| | Drawing ratio | — | 10.0 | 2.8 | 10.0 | 10.0 | 3.0 | 2.8 |
| 2nd drawing step condition | Drawing temperature | ° C. | — | 100 | — | — | 149 | 105 |
| | Drawing ratio | — | — | 5.0 | — | — | 4.0 | 5.0 |
| Cooling process after drawing | Cooling rate | ° C./sec | 54.0 | 54.0 | 10.0 | 54.0 | no cooling process | no cooling process |
| Winding process | Tensile tension for winding | cN/dtex | 0.1 | 0.1 | 0.1 | 1.0 | 1.0 | 5.0 |
| Fiber property | Intrinsic viscosity (fiber) | dL/g | 1.8 | 1.8 | 1.8 | 1.8 | 18 | 1.8 |
| | Linear density | dtex | 513 | 451 | 512 | 522 | 43 | 438 |
| | Tensile strength | cN/dtex | 12 | 15.1 | 12.2 | 12.9 | 30.1 | 18 |
| | Modulus | cN/dtex | 505 | 588 | 512 | 638 | 912 | 820 |
| | Thermal stress (at 40° C.) | cN/dtex | 0.02 | 0.03 | 0.02 | 0.04 | 0.01 | 0.14 |
| | Thermal stress (at 70° C.) | cN/dtex | 0.18 | 0.22 | 0.11 | 0.23 | 0.02 | 0.01 |

TABLE 1-continued

| | | | | | | | |
|---|---|---|---|---|---|---|---|
| Shrinkage rate (at 40° C.) | % | 0.3 | 0.3 | 0.4 | 0.4 | 0.5 | 0.7 |
| Shrinkage rate (at 70° C.) | % | 3.9 | 4.5 | 3.2 | 4.1 | 0.4 | 0.5 |
| Cut resistance | — | 4.1 | 4.6 | 4.0 | 4.7 | 5.1 | 3.6 |

| | | unit | Comparative Example 3 | Comparative Example 4 | Comparative Example 5 | Comparative Example 6 | Comparative Example 7 |
|---|---|---|---|---|---|---|---|
| Characteristic of a raw material | Intrinsic viscosity (raw polymer) | dL/g | 1.6 | 1.9 | 8.2 | 1.9 | 1.6 |
| | Mw (raw polymer) | — | 90,000 | 91,000 | 1,020,000 | 115,000 | 90,000 |
| | Mw/Mn (raw polymer) | — | 2.3 | 7.3 | 5.2 | 2.8 | 2.3 |
| | Spinning method | | melt spinning | melt spinning | melt spinning | melt spinning | melt spinning |
| Spinning condition | Nozzle temperature | ° C. | 290 | 290 | 300 | 290 | 290 |
| | Single hole throughput | g/min | 0.5 | 0.5 | not discharging | 0.5 | 0.5 |
| | Spinning speed | m/min | 300 | 300 | | 500 | 300 |
| 1st drawing step condition | Drawing temperature | ° C. | 25 | 25 | | 25 | 25 |
| | Drawing ratio | — | 2.8 | 2.8 | | 2.0 | 2.8 |
| 2nd drawing step condition | Drawing temperature | ° C. | 90 | 90 | | 100 | 90 |
| | Drawing ratio | — | 3.1 | 3.1 | | 6.0 | 3.1 |
| Cooling process after drawing | Cooling rate | ° C./sec | no cooling process | no cooling process | | no cooling process | 10.0 |
| Winding process | Tensile tension for winding | cN/dtex | 5.0 | 0.005 | | 5.0 | 5.0 |
| Fiber property | Intrinsic viscosity (fiber) | dL/g | 1.6 | 1.8 | | 1.9 | 1.6 |
| | Linear density | dtex | 710 | 702 | | 26 | 699 |
| | Tensile strength | cN/dtex | 7.8 | 7.9 | | 17.6 | 7.9 |
| | Modulus | cN/dtex | 249 | 295 | | 945 | 285 |
| | Thermal stress (at 40° C.) | cN/dtex | 0.15 | 0.08 | | 0.14 | 0.15 |
| | Thermal stress (at 70° C.) | cN/dtex | 0.04 | 0.02 | | 0.02 | 0.12 |
| | Shrinkage rate (at 40° C.) | % | 0.8 | 0.4 | | 0.7 | 0.9 |
| | Shrinkage rate (at 70° C.) | % | 0.7 | 0.5 | | 0.6 | 2.9 |
| | Cut resistance | — | 3.6 | 2.8 | | 3.6 | 3.6 |

INDUSTRIAL APPLICABILITY

The highly shrinkable polyethylene fiber of the present invention has a low shrinkage rate and a low shrinkage stress at about room temperature at which the polyethylene fiber is used as products, and has a high shrinkage rate and a high shrinkage stress at a temperature which is higher than or equal to 70° C., and is not higher than 100° C. Therefore, the highly shrinkable polyethylene fiber of the present invention has a great tying force when shrunk, and can have an excellently high shrinkage at a low temperature at which mechanical property of a polyethylene is not deteriorated. Furthermore, strings, woven/knitted textiles, gloves, and ropes of the present invention are excellent in cut-resistance, and offer excellent performance when used as, for example, meat tying strings, safety gloves, safety ropes, and finishing ropes. Furthermore, the highly shrinkable polyethylene fiber of the present invention is widely usable as not only formed products, but also industrial materials and packing materials such as highly shrinkable fabrics and tapes, and the like.

The invention claimed is:

1. A highly functional polyethylene fiber, wherein an intrinsic viscosity [η] is higher than or equal to 0.8 dL/g, and is not higher than 4.9 dL/g, ethylene is substantially contained as a repeating unit, and a thermal stress at 40° C. is lower than or equal to 0.10 cN/dtex, and a thermal stress at 70° C. is higher than or equal to 0.05 cN/dtex, and is not higher than 0.30 cN/dtex.

2. The highly functional polyethylene fiber according to claim 1, wherein a weight average molecular weight (Mw) of a polyethylene ranges from 50,000 to 600,000, and a ratio (Mw/Mn) of the weight average molecular weight to a number average molecular weight (Mn) is less than or equal to 5.0.

3. The highly functional polyethylene fiber according to claim 1, wherein a specific gravity is higher than or equal to 0.90, an average tensile strength is higher than or equal to 8 cN/dtex, and a modulus ranges from 200 cN/dtex to 750 cN/dtex.

4. A woven/knitted textile formed of the highly functional polyethylene fiber according to claim 1.

* * * * *